US010240587B2

(12) United States Patent
Roos

(10) Patent No.: US 10,240,587 B2
(45) Date of Patent: Mar. 26, 2019

(54) HYDROSTATIC AXIAL PISTON MACHINE

(71) Applicant: Robert Bosch GmbH, Stuttgart (DE)

(72) Inventor: Peter Roos, Horb (DE)

(73) Assignee: Robert Bosch GmbH, Stuttgart (DE)

( * ) Notice: Subject to any disclaimer, the term of this patent is extended or adjusted under 35 U.S.C. 154(b) by 56 days.

(21) Appl. No.: 15/660,175

(22) Filed: Jul. 26, 2017

(65) Prior Publication Data

US 2018/0058432 A1 Mar. 1, 2018

(30) Foreign Application Priority Data

Aug. 29, 2016 (DE) ..... 10 2016 216 132
Jan. 25, 2017 (DE) ..... 10 2017 201 158

(51) Int. Cl.

*F01B 13/04* (2006.01)
*F04B 1/20* (2006.01)
*F04B 11/00* (2006.01)
*F03C 1/06* (2006.01)

(52) U.S. Cl.

CPC ..... *F04B 1/2064* (2013.01); *F03C 1/0663* (2013.01); *F04B 1/2014* (2013.01); *F04B 11/00* (2013.01); *F04B 11/0008* (2013.01)

(58) Field of Classification Search

CPC .. F04B 1/2064; F04B 11/008; F04B 11/0016; F04B 11/0025; F04B 11/0033

See application file for complete search history.

(56) References Cited

U.S. PATENT DOCUMENTS 3,382,813 A * 5/1968 Schauer ..... F01B 3/0032 91/506
4,934,251 A * 6/1990 Barker ..... F04B 1/2021 91/499
5,247,869 A * 9/1993 Palmberg ..... F04B 11/0008 91/487
6,086,336 A * 7/2000 Welschof ..... F04B 11/0016 417/308
6,116,871 A * 9/2000 Backe ..... F04B 11/0016 417/540

(Continued)

FOREIGN PATENT DOCUMENTS

DE 10 2013 226 344 A1 6/2015
DE 10 2014 223 489 A1 5/2016
DE 10 2014 223 492 A1 5/2016

*Primary Examiner* — Michael Leslie

(74) *Attorney, Agent, or Firm* — Maginot, Moore & Beck LLP

(57) ABSTRACT

A hydrostatic axial piston machine includes a pot-like housing, a connection plate that closes the pot-like housing, a rotatably mounted cylinder drum, and pistons arranged in cylinder chambers of the cylinder drum. The cylinder chambers are each alternately connected via a cylinder chamber opening to a low-pressure control opening and a high-pressure control opening of a resting control part. The control part has two switching regions located between the low-pressure and high pressure control openings. A piston reverses its movement direction in a dead center within the two switching regions. In the switching region, the cylinder chambers are connected via a connecting line to a fluid volume arranged in the housing. The fluid volume extends between the connection plate and the housing such that it is sealed to an interior by the connection plate and the housing.

13 Claims, 2 Drawing Sheets

(56) References Cited

U.S. PATENT DOCUMENTS 8,047,120 B2 * 11/2011 Shinohara ..... F04B 1/2042
91/499
2017/0321668 A1 * 11/2017 Merz ..... F04B 11/0025

* cited by examiner

HYDROSTATIC AXIAL PISTON MACHINE

This application claims priority under 35 U.S.C. § 119 to patent application nos. DE 10 2016 216 132.6, filed on Aug. 29, 2016 in Germany, and DE 10 2017 201 158.0, filed on Jan. 25, 2017 in Germany, the disclosures of which are incorporated herein by reference in their entirety.

BACKGROUND

The disclosure relates to a hydrostatic axial piston machine having a pot-like housing which has a housing base and a housing jacket, having a connection plate, which closes the pot-like housing at its open side, having a rotatably mounted cylinder drum which is located in an interior formed by the housing and the connection plate and has a plurality of cylinder chambers in which pistons executing a stroke movement during operation are arranged. During operation, each cylinder chamber is alternately connected, via a cylinder chamber opening, to a low-pressure control opening and a high-pressure control opening of a resting control part. At this control part, two switching regions, within which a piston reverses its movement direction in a dead center, are located between the low-pressure control opening and the high-pressure control opening. In the switching region, after leaving one control opening and still prior to reaching the other control opening, the cylinder chambers are connected via a connecting line to a fluid volume arranged in the housing. It is thus possible for sudden changes in pressure in the cylinder chambers to be prevented so that the load on the components, pressure pulsations and the noise emissions associated with rapid variations in pressure are reduced.

Since the cylinder chambers are predominantly connected to the fluid volumes when switching from low pressure to high pressure and a pre-compression of the fluid located in a cylinder chamber thereby takes place, the fluid volume is generally also referred to as a pre-compression volume. If the cylinder chambers are connected to a fluid volume when switching from high pressure to low pressure, then this is, strictly speaking, a pre-decompression volume. However, this expression is not used below.

The terms fluid volume or pre-compression volume are used below to refer to a cavity which is filled, or is to be filled, with a liquid pressurizing medium, for example with hydraulic oil, and in which a variation in pressure is associated with an inflow or an outflow of pressurizing medium solely as a result of the compressibility of the pressurizing medium.

A hydrostatic axial piston machine is disclosed in DE 10 2013 226 344 A1. According to this document, the fluid volume is formed as an interior of a bottle-like separate hollow body which is fastened by its neck in a bore of the connection plate. The advantage of this solution is the high reliability against leakage into the environment since there is no interface to the outside of the housing. In the event of a leak between the hollow body and the connection plate, the leakage oil flowing into the interior merely increases. The disadvantage is that the bottle-like hollow body is difficult to produce. Moreover, the manner in which the hollow body is fastened in the connection plate has to withstand the forces seeking to push the hollow body out of the bore.

A hydrostatic axial piston machine having a pre-compression volume is also disclosed in DE 10 2014 223 492 A1. According to this document, the fluid volume is formed as a cavity in the connection plate, which is closed to the interior by a plug. It is also advantageous here that leakage between the connection plate and the plug only takes place into the interior. However, there is only a small amount of space available in the connection plate for a pre-compression volume.

A hydrostatic axial piston machine having a pre-compression volume is also disclosed in DE 10 2014 223 489 A1. According to this document, the fluid volume is a cavity which is formed by the housing and the connection plate. An embodiment is shown in which the cavity is composed of a sub-chamber in a flange face of the connection plate, which flange face faces the housing, and a sub-chamber in a flange face of the housing, which flange face faces the connection plate. There is the possibility here of an outward leakage into the environment.

The object of the disclosure is to design a hydrostatic axial piston machine having the features of the disclosure such that the fluid volume is realized in a simple and economical manner.

SUMMARY

This object is achieved in a hydrostatic axial piston machine having the features of the disclosure in that the fluid volume extends between the connection plate and the housing in such a way that it is sealed to the interior by the connection plate and the housing. In a hydrostatic piston machine according to the disclosure, the fluid volume can be realized in a simple manner. The basic solution can be flexibly adapted to the features of a machine series or a nominal size and is economical. In the event of a leak, the leakage oil merely increases. Moreover, condition monitoring is even possible without any risk to the environment.

Advantageous embodiments of a hydrostatic axial piston machine are revealed in the subclaims.

The fluid volume is particularly preferably formed substantially by a separate elongated hollow body which extends between the connection plate and the housing and which is sealed to the interior by the connection plate at one end and by the housing at the other end. The separate elongated hollow body can be a general cylindrical shape. The separate elongated hollow body is preferably a circular-cylindrical shape, i.e. that generally referred to as a tube, and is therefore a standard component. With a given length of the separate cylindrical elongated hollow body, the required volume, which depends, amongst other things, on the dead volume and on the operating data of the axial piston machine, is adjusted via the cross section, in particular via the diameter, and can therefore be varied as required. A high degree of flexibility is thus achieved.

If the available installation space is to be utilized particularly effectively, it is possible to select a kidney-shape for the cross section, which is adapted to the outer contour of the cylinder drum. In addition, by arranging a hollow body along the cylinder drum, the efficiency of the axial piston machine is also increased since churning losses are reduced.

The separate elongated hollow body can be connected in a simple manner to the housing and the connection plate in that the housing and the connection plate each have a depression and in that the separate elongated hollow body dips into the depressions. The depressions ensure that the separate elongated hollow body is secured in position perpendicularly to the rotational axis of the cylinder drum. This is, in itself, also possible using hollow mandrels on the connection plate and on the housing, which project into the hollow body. However, depressions appear to be more favorable. No screwing or pressing of the hollow body is necessary here since the separate elongated hollow body is captively held by the connection plate in one axial direction and by the housing in the opposite axial direction.

The seal between the separate elongated hollow body and the connection plate and the housing is effected by a respective sealing ring, wherein the seal is preferably realized radially.

With low material costs, a seamless drawn hollow pressure tube as a separate elongated hollow body fulfills the requirements for pressure resistance of a fluid volume which is also subjected to the high pressure of the axial piston machine.

If the space available for a depression on the connection plate or on the housing is less than that required by the cross section of the separate elongated hollow body itself, this can have, at one end or at both ends, a connecting piece which differs in terms of its outer shape from the outer shape between the two ends and which dips into a depression.

The separate elongated hollow body preferably extends from the connection piece to the housing base of the housing.

However, it is also conceivable for the separate elongated hollow body to extend to a bearing which protrudes from the housing jacket at a spacing from the housing base.

The fluid volume can be formed directly in the material of the housing and reach to the connection plate.

In a hydrostatic axial piston machine, the connection plate usually has a substantially planar inner face delimiting the interior, in which the depressions are located and from which pressure channels leading to the connections originate. The inner face is conventionally machined to provide a sealed contact between the connection plate and a distributor plate serving as a control part or directly against the cylinder drum. For such machining, it is particularly favorable if the connection plate has a depression and not a projection for receiving the separate elongated hollow body.

BRIEF DESCRIPTION OF THE DRAWINGS

An exemplary embodiment of a hydrostatic axial piston machine according to the disclosure and a variant of a part are illustrated in the drawings. The disclosure is now explained in more detail with reference to the figures of these drawings, which show.

DETAILED DESCRIPTION

Figure 1:
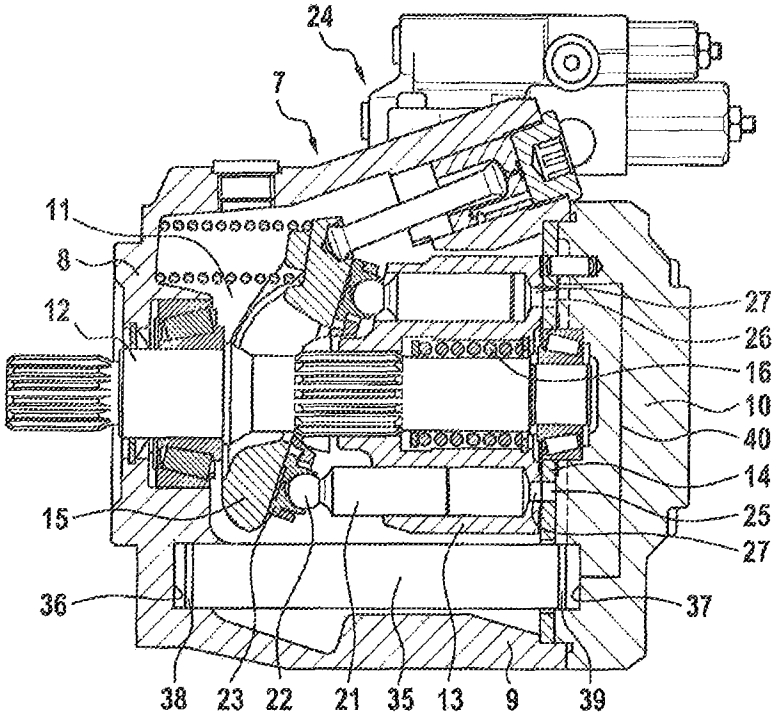
FIG. 1 a longitudinal section through the axial piston machine.

The hydrostatic axial piston machine according to FIG. 1 may be provided for use as a hydrostatic axial piston pump and is constructed in a swash plate design with a displacement volume which adjustable between a zero displacement volume and a maximum displacement volume. In the drawing, the hydrostatic axial piston pump is shown in a state with a maximum displacement volume. The axial piston pump It comprises a pot-like housing 7 having a housing base 8 and a housing jacket 9, a connection plate 10 which closes the open end of the housing 7 and encloses an interior 11 together with the housing, a drive shaft 12, a cylinder drum 13, a control plate 14, which is located between the cylinder drum 13 and the connection plate 10 and is fixed relative to the connection plate, and a pivot balance 15 which is adjustable in terms of its inclination with respect to the axis of the drive shaft and the cylinder drum. The pivot balance here can be pivoted from a position in which is it perpendicular to the axis of the drive shaft 12 and the displacement volume is zero until it is in the position shown.

The drive shaft 12 is rotatably mounted in the base 8 of the housing 7 and in the connection plate 10 via roller bearings and reaches, centered, through the cylinder drum 13. This is connected in a rotationally fixed, but axially movable manner to the drive shaft 12 and can therefore abut against the control plate 14 without play under the action of a central spring 16 and the pressure forces arising during operation.

A plurality of cylinder chambers, especially cylinder bores 20 here, are formed in the cylinder drum 13, which are distributed evenly over the circumference and extend parallel to the axis of the drive shaft. A respective piston 21 is axially movably guided in each cylinder bore 20. The pistons 21 have, at the end facing the pivot balance 15, a spherical piston head 22 which dips into a corresponding recess in a sliding block 23 so that a ball and socket joint is formed between the piston and the sliding block. The pistons are supported against the pivot balance 15 by means of the sliding blocks. During operation, the pistons execute a stroke movement in the cylinder bores. The extent of the stroke here is specified by the inclination of the pivotable pivot balance 15. An adjusting device 24 is provided to adjust the inclination of the pivot balance 15.

The control plate 14 has two kidney-shaped control openings 25 and 26 of which one is open to a first fluid channel in a manner not illustrated in more detail on its side remote from the cylinder drum 16 and the other is open to a second fluid channel in a manner not illustrated in more detail on its side remote from the cylinder drum 16. The fluid channels are formed in the connection plate, wherein the first fluid channel leads to a first fluid connection on the connection plate and the second fluid channel leads to a second fluid connection on the connection plate. The control opening 25 may be the low-pressure control opening and the control opening 26 may be the high-pressure control opening. The cylinder bores 17 are open to the end face of the cylinder drum 16 which faces the control plate 14 via cylinder chamber openings referred to below as outlets 27. Upon rotation of the cylinder drum 16, the outlets 27 move over the control openings 25 and 26 of the control plate 24 and are successively connected to the first fluid channel and to the second fluid channel of the connection plate via the control openings during a revolution. When changing from the one control opening to the other control opening, the outlets move over a reversing region of the control plate in which they are fluidically connected to a control opening, if necessary in a throttled manner.

In the section shown in the figure, the control openings 25 and 26, like the first fluid channel and the second fluid channel in the connection plate 11, are not themselves visible. Rather, one control opening is located behind the plane of the drawing and the other control opening is located in front of the plane of the drawing. However, the two control openings 25 and 26 are drawn-in for better understanding.

To prevent rapid variations in pressure in the cylinder bores 20 in the switching phase from the low-pressure control opening 25 to the high-pressure control opening 26 and therefore to reduce associated high loads on the components, pressure pulsations and noise emissions, the illustrated hydrostatic axial piston pump according to FIG. 1 is equipped with a separate elongated hollow body, namely with a tube 35 having a circular-cylindrical inner diameter and having a circular-cylindrical outer diameter, the inside of which represents a pre-compression volume. The tube 35 is open at its ends and extends outside the cylinder drum 13 axially, i.e. parallel to the drive shaft 12, between the housing base 8 and the connection plate 10 and dips with its one end into a blind hole 36 located in the housing base 8 and with its other end into a blind hole 37 located in the connection plate. The inside of the tube is sealed with respect to the interior 11 by a sealing ring 38 arranged within the blind hole 36, between the tube 35 and the housing base 8, and a sealing ring 39 arranged within the blind hole 37, between the tube 35 and the connection plate 10.

A connecting line 40 originates between the blind hole 37 in the connection plate 10 and continues initially in the connection plate 10 and in a bore crossing the control plate 25 so that it is open at the side of the control plate 25 which faces the cylinder drum 13. The opening is located within the switching region of the low-pressure control opening 25 and the high-pressure control opening 26, and the outlets 27 of the cylinder bores 20 move over it.

For a switching procedure of a cylinder bore 20, the following sequence is then conceivable:

The outlet 27 of the cylinder bore 20 moves over the low-pressure control opening 25 of the control plate 14 so that there is a suction pressure in the cylinder bore. The outlet 27 then leaves the low-pressure control opening 25 and opens to the connecting line 40. Pressure fluid now flows, optionally throttled, from the inside of the tube 35, which is under high pressure, into the cylinder bore 20 so that, with the decreasing pressure in the tube 35, the pressure in the cylinder bore increases at the most to a value at which the pressure in the cylinder bore is equal to the pressure in the tube 35. The opening then moves to overlap a switching groove, if present, which is located at the high-pressure control opening 26, and the high-pressure control opening itself, wherein the opening of the connecting line 40 is initially also still overlapped. The pressure in the cylinder bore 20 now increases to the high pressure. Moreover, fluid flows from the high-pressure region via the connecting line 40 into the tube 35 so that the pressure there again increases to a higher pressure, optionally to the high pressure. The procedure is repeated during the switching of the next cylinder bore.

According to FIG. 1, the tube 35 is arranged in a central plane of the axial piston pump, which is perpendicular to the pivot axis of the swash plate 15 and passes through the rotational axis of the drive shaft 12 and cylinder drum 13. An arrangement to the side of this central plane is also possible to enable a more compact construction.

Instead of a single pre-compression volume, depending on operating parameters, for example depending on the rotational speed at which the hydrostatic axial piston machine is predominantly operated, or depending on the high pressure at which the hydrostatic axial piston machine is predominantly operated, it is also possible to provide a plurality of pre-compression volumes which operate in parallel with one another, i.e. are connected to the same opening at the control plate 25, or which are associated with different switching regions or different switching openings in the same switching region. The one pre-compression volume or the plurality of pre-compression volumes can, of course, also be constructed differently depending on operating parameters, for example depending on the rotational speed at which the hydrostatic axial piston machine is predominantly operated or depending on the high pressure at which the hydrostatic axial piston machine is predominantly operated.

With a given length of the tube, the required volume, which depends on the dead volume and the operating data, is adjusted by selecting a tube with a particular inner diameter and can be varied as required. This demonstrates the high flexibility of the solution. The term dead volume is used here to refer to the volume of the free part of a cylinder bore 20, including the outlet 27, when the corresponding piston changes from moving into the cylinder bore to moving out of it.

Figure 2:
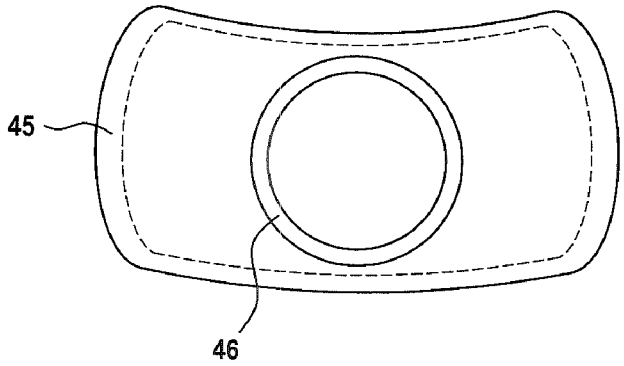
FIG. 2 a view of a hollow body used as a pre-compression volume, which is modified with respect to FIG. 1.

FIG. 2 shows a hollow body 45 which can be used as an alternative to the tube 35 in a hydrostatic axial piston pump. The hollow body 45 is substantially kidney-shaped in cross section and has a respective connecting piece 46 at its two ends, with which it can dip into the blind holes 36 and 37 in the housing base 8 and the connection plate 10. The available installation space is utilized very effectively as a result of the kidney-shaped cross section. A secondary effect is that, as with the tube 35, churning losses are reduced. The efficiency of the axial piston pump is increased.

LIST OF REFERENCE SIGNS

7 Pot-like housing
8 Housing base
9 Housing jacket
10 Connection plate
11 Interior
12 Drive shaft
13 Cylinder drum
14 Control plate
15 Pivot balance
16 Central spring
20 Cylinder bores
21 Piston
22 Piston head
23 Sliding block
24 Adjusting device
25 Control opening
26 Control opening
27 Outlets
35 Tube
36 Blind hole in 8
37 Blind hole in 10
38 Sealing ring
39 Sealing ring
45 Hollow body
46 Connecting piece on 45

What is claimed is:

1. A hydrostatic axial piston machine, comprising:

a pot-like housing that has a housing base and a housing jacket, the housing jacket defining an open side of the pot-like housing;

a connection plate that closes the pot-like housing at the open side;

a rotatably mounted cylinder drum that is located in an interior formed by the housing and the connection plate, the cylinder drum having a plurality of cylinder chambers; and a plurality of pistons arranged respectively in the cylinder chambers of the cylinder drum, the pistons configured to execute a stroke movement during operation, wherein each cylinder chamber is configured to be alternately connected via a cylinder chamber opening to a low-pressure control opening and a high-pressure control opening of a resting control part at which two switching regions, within which a respective piston reverses its movement direction in a dead center, are located between the low-pressure control opening and the high-pressure control opening, and wherein, in the switching region, the cylinder chambers are configured to be connected via a connecting line to a fluid volume located in the interior, the fluid volume extending between the connection plate and the housing such that the fluid volume is sealed to the interior by the connection plate and the housing.

2. The hydrostatic axial piston machine as claimed in claim 1, wherein the fluid volume is formed substantially by a separate elongated hollow body which extends between the connection plate and the housing and which is sealed to the interior by the connection plate at one end and by the housing at the other end.

3. The hydrostatic axial piston machine as claimed in claim 2, wherein the separate elongated hollow body has a cylindrical shape.

4. The hydrostatic axial piston machine as claimed in claim 3, wherein the separate elongated hollow body has a circular-cylindrical shape.

5. The hydrostatic axial piston machine as claimed in claim 3, wherein the separate elongated hollow body has a kidney-shaped cross section adapted to the cylinder drum.

6. The hydrostatic axial piston machine as claimed in claim 2, wherein the housing and the connection plate each have a depression, and wherein the separate elongated hollow body dips into the depressions.

7. The hydrostatic axial piston machine as claimed in claim 6, wherein a seal is arranged in each depression between the separate elongated hollow body.

8. The hydrostatic axial piston machine as claimed in claim 2, wherein the separate elongated hollow body is seamlessly drawn.

9. The hydrostatic axial piston machine as claimed in claim 6, wherein the separate elongated hollow body has, at least at one end, a connecting piece which differs in terms of its outer shape from the outer shape between the two ends and which dips into a depression.

10. The hydrostatic axial piston machine as claimed in claim 2, wherein the separate elongated hollow body extends from the connection plate to the housing base of the housing.

11. The hydrostatic axial piston machine as claimed in claim 2, wherein the separate elongated hollow body extends to a bearing which protrudes from the housing jacket at a spacing from the housing base.

12. The hydrostatic axial piston machine as claimed in claim 1, wherein the fluid volume is formed directly in the material of the housing and reaches to the connection plate.

13. The hydrostatic axial piston machine as claimed in claim 1, wherein the connection plate has a substantially planar inner face delimiting the interior.

* * * * *